United States Patent [19]

Raulins

[11] Patent Number: 4,726,424

[45] Date of Patent: Feb. 23, 1988

[54] WELL APPARATUS

[76] Inventor: George M. Raulins, 12408 Veronica, Farmers Branch, Tex. 75234

[21] Appl. No.: 909,597

[22] Filed: Sep. 22, 1986

Related U.S. Application Data

[63] Continuation of Ser. No. 724,171, Apr. 17, 1985, abandoned.

[51] Int. Cl.[4] ..... E21B 15/02

[52] U.S. Cl. ..... 166/338; 166/341; 166/343; 166/363

[58] Field of Search ..... 166/336, 338, 341, 343, 166/344, 348, 360, 361, 363, 364, 105; 285/133 A

[56] References Cited

U.S. PATENT DOCUMENTS

| | | | |
|---|---|---|---|
| Re. 27,464 | 8/1972 | Taylor, Jr. | 166/5 |
| 3,155,401 | 11/1964 | Musolf | 166/344 |
| 3,163,222 | 12/1964 | Foster et al. | 166/344 |
| 3,411,576 | 11/1968 | Taylor, Jr. | 166/5 |
| 3,427,048 | 2/1969 | Brown | 166/338 |
| 3,451,475 | 6/1969 | Price | 166/5 |
| 3,457,991 | 7/1969 | Sizer et al. | 166/5 |
| 3,568,715 | 3/1971 | Taylor, Jr. | 137/613 |
| 3,646,995 | 3/1972 | Manes et al. | 166/5 |
| 3,858,649 | 1/1975 | Wray et al. | 166/162 |
| 3,860,069 | 1/1975 | Wray et al. | 166/264 |
| 3,870,101 | 3/1975 | Helmus | 166/5 |
| 3,915,228 | 10/1975 | Giebler | 166/224 |
| 3,955,623 | 5/1976 | Aumann | 166/6 |
| 3,967,647 | 7/1976 | Young | 137/614.11 |
| 4,009,753 | 3/1977 | McGill et al. | 166/55.1 |
| 4,076,077 | 2/1978 | Nix et al. | 166/315 |
| 4,116,272 | 9/1978 | Barrington | 166/340 |
| 4,126,183 | 11/1978 | Walker | 166/338 |
| 4,252,187 | 2/1981 | Wilson | 166/115 |
| 4,306,623 | 12/1981 | Brooks | 166/322 |
| 4,320,804 | 3/1982 | Brooks | 166/339 |
| 4,375,239 | 3/1983 | Barrington et al. | 166/336 |
| 4,494,609 | 1/1985 | Schwendemann | 166/336 |

FOREIGN PATENT DOCUMENTS

| | | |
|---|---|---|
| 1056716 | 6/1979 | Canada . |
| 1505557 | 3/1978 | United Kingdom . |
| 2035416 | 6/1980 | United Kingdom . |
| 1574953 | 9/1980 | United Kingdom . |
| 2055132 | 2/1981 | United Kingdom . |
| 2055133 | 2/1981 | United Kingdom . |
| 2086452 | 5/1982 | United Kingdom . |
| 2097444 | 11/1982 | United Kingdom . |
| 2103689 | 2/1983 | United Kingdom . |

OTHER PUBLICATIONS

Brochure—Texas Iron Works, Inc.

*Primary Examiner*—Stephen J. Novosad
*Assistant Examiner*—William P. Neuder
*Attorney, Agent, or Firm*—Vaden, Eickenroht, Thompson & Boulware

[57] ABSTRACT

Apparatus is disclosed for use in testing a formation of and/or performing remedial work within a subsea well by means of a pipe string which is lowered through a conductor depending from a drilling vessel at the water surface and releasably connected at its lower end to a blowout preventor stack mounted on the head of the well. The string is landed within the well head for depending from the wellhead into the well bore, and a connected as part of the pipe string is adapted to open and close the string in response to the supply and exhaust of control fluid from a source at the surface, whereby the well may be controlled upon closing the string and raising of the upper end of the string above the means for opening and closing it and closing of the blowout preventor thereabove.

27 Claims, 13 Drawing Figures

WELL APPARATUS

This application is a continuation of my co-pending application, Ser. No. 724,171, filed Apr. 17, 1985, now abandoned, and entitled "Well Apparatus".

This invention relates generally to apparatus for use in performing various functions within a well in response to control fluid from a source at the surface. In one of its aspects, it relates to improvements in apparatus for use in testing a formation of and/or performing remedial work within a subsea well by means of a pipe string which is lowered through a conductor depending from a drilling vessel at the water surface and releasably connected at its lower end to a blowout preventer stack, and which is landed upon the head of the well on which the stack is mounted for depending from the wellhead into the well bore, and wherein a means connected as part of the pipe string is adapted to open and close the string in response to the supply and exhaust of such control fluid so that the well may be controlled upon raising of the upper end of the string thereabove. In another of its aspects, it relates to improvements in apparatus for releasably connecting the lower end of a pipe string, such as the lower end of the upper end of the above described string, to a well conduit disposed within a well bore, which may be the means connectible to the upper end of the lower end of the pipe string for selectively closing the string.

During the drilling of a well of this type, a drill string is raised from and lowered into the well bore by means of suitable equipment on the drilling vessel. Upon drilling of the well to the desired depth, and setting of an outer casing which depends from the wellhead, the pipe string is lowered into and packed off within the casing to permit testing of the prospective formation. The weight of the string is supported by means of a hangar which is connected about it for landing on a seat in the bore of the wellhead to dispose the means for closing the string beneath the level of blind rams of the preventer stack. During testing, the closing means is held open to permit well fluid to flow therethrough. The well may be closed in for routine reasons by conventional valves at the surface, in which case it is not necessary to close off the pipe string by the closing means above mentioned.

However, in the event of a storm or other emergency conditions, pipe rams of the preventer stack beneath the blind rams are moved to positions to close off the bore therethrough about the lower end of the string (sometimes called a "slick joint"), and the pipe string is closed by the closing means. The upper end of the test string is released and raised from such closing means, the conductor is released and removed from the stack, and the blind rams of the stack are moved into positions closing the bore above the closing means to control the well and permit the vessel to be moved to another location if conditions require. Upon return of normal conditions, the conductor may be reconnected to the stack, the blind rams may be opened, the upper end of the string reconnected to the closing means, and the closing means of the string reopened to resume testing. Control fluid for operating the closing means may be supplied to or exhausted from fluid responsive means thereof from a source on the vessel and connected to such closing means by tubes extending along the upper end of the string and having ends adapted to be fluidly connected with the ends of conduits in the closing means leading to and from the operating means.

In conventional apparatus of this type, the closure member is either a ball or flapper so that although it is possible to lower lines such as thin wall pipe through the pipe string to perform remedial work on the well, the balls and flappers are not capable of closing sealingly thereabout. Also, since the cutting ability of flappers is nearly non-existent, and that of balls limited to wire and thin wall soft pipe, they are ineffective in cutting or sealing about heavier wall threaded pipe required for servicing wells when high pressures and or rotation is required. In like manner, it may not be possible to lower electrical conductor lines therethrough for perforating or taking bottom hole measurements, or solid lines therethrough for actuating bottom hole devices while being assured of sealing about them should conditions require.

It is therefore a primary object of this invention to provide apparatus of this type through which such remedial work may be performed under circumstances in which a storm or other emergency conditions may be imminent.

Another object is to provide such apparatus which, despite its added versatility for these purposes, is nevertheless of a construction which is compact so as to occupy a minimum of space within the bore of the preventer stack, and which uses more or less conventional closure elements and means for operating same which are easily installed and replaced.

In conventional apparatus of this type, the closing means is often moved between opened and closed positions by operating means which requires control fluid at a pressure to provide a force to overcome high forces due to the pressure of well fluid in the string and seals that must hold the differential pressures between well pressure and control fluid pressure. It's another object of this invention to provide such apparatus in which forces due to well fluid which must be overcome by control fluid are relatively small, and the seals need not hold the differential pressures between the well bore and control fluid pressure.

In order to control not only the operating means for the closure elements, but also to perform other fluid operations in or below the closing means, or to supply other fluid from the vessel to locations within the well, as well as to operate the means which releasably connects the upper end of the string with the closing means, the ends of several conduits must be fluidly connected as telescoping ends of the lower end of the string and the closing apparatus are connected to one another. Conventionally, this requires that the ends to be connected be isolated from other ends by seals about the telescoping ends which define annular spaces thereabout with which the ends connect. This of course requires that the connecting means be of substantial height, and it is an object of this invention to provide connecting means for this or similar purposes which require much less vertical space.

It is of course possible for the means for fluidly operating the parts which connect the lower end of the string to the closing means to malfunction. For example, the tube connecting the control fluid with a conduit leading to the operating means may be broken or clogged. It's difficult to release these parts, particularly at the subsea depths at which they are connected, and it's therefore a further object of this invention to provide connecting means for this or similar purposes remote from the surface which enable the parts to be released from connection by a simple mechanical manipulation from the well surface.

These and other objects are accomplished, in accordance with the illustrated and preferred embodiment of the present invention, by means for closing the string which comprises a body having a bore therethrough connectible at its lower end to the lower end of the string and means at its upper end releasably connectible to the lower end of the upper end of the string, whereby the body may be raised and lowered with the string into and out of a position landed within the bore of the blowout preventer stack beneath the level of blind rams therein. More particularly, the body includes guideways which extend from its bore, rams which are slidable in the guideway between positions opening the bore of the body, cylinders in the body, pistons reciprocable in the cylinders and connected to the rams for moving them between open and closed positions, and means which is responsive to the supply and exhaust of control fluid from a source at the surface level for causing the pistons to move the rams between opened and closed positions. More particularly, there are at least two sets of vertically spaced guideways, with the rams in the upper set being of such construction as to close an open bore. In the event the operator of the well is not concerned with emergencies, and remedial work is not to be performed through the string, the other set or sets of rams may also be of such construction as to close on an open bore and thus provide redundant means for controlling the well. Alternatively in the event remedial work is to be performed, following testing and when the well is on production or during the period when a problem occurs, requiring the use of an inner pipe string, the rams of a lower set are of such construction as to close the bore about a line extending therethrough, whether it is a pipe or a wire. Preferably, the rams within a third and lowermost set of guideways are so constructed as to shear a line within the bore, whereby the upper end of the string may be released therefrom and raised from the closure apparatus in the event of an emergency. Thus, remedial operations may be performed through the string even though it may be necessary to shut in the well in the event of a storm or other emergency conditions.

Since the apparatus thus far described is basically similar in overall construction to a standard type of blowout preventer, at least the rams and pistons, and possibly other operating parts, may be available from those sources on at least of conventional construction. Also, the body includes continuations of the guideways and cylinders which extend through the outer side of the body, whereby the rams and pistons may be moved into and out of the guideways and cylinders from the outer side of the body, thus facilitating assembly as well as repair of the apparatus. In its preferred form, the body is generally cylindrical in shape for fitting closely within the bore of the blowout preventer stack, and there are a pair of cylinders in the body which extend parallel to and on opposite sides of each guideway, with rods on the pistons mounted in the cylinders being connected to rods on the rams for moving them between opened and closed positions, whereby the apparatus is of minimum size in a direction longitudinally of its bore. Due to its shape and size, the body is capable of well containing fluids of high pressure.

More particularly, the pistons are caused to move between their opened and closed position by one or more accumulations within the body for containing a source of fluid under pressure which connects with the cylinders on one side of the pistons to urge the rams toward closed positions, and means in the body connecting with the cylinders on the other side of the piston for supplying or exhausting control fluid from a remote source to or from such other side at a pressure which overcomes accumulator pressure to hold the rams open as long as such pressure is maintained. Thus, the pressure of the source of fluid at the surface level may be so controlled as to normally hold the rams open, but permit them to close when that pressure is exhausted or reduced a sufficient amount. In such an operating system, the only force due to well fluid which must be overcome by the accumulator fluid to close the rams is that acting over the relatively small cross sectional areas of the rods connecting to the rams.

In the preferred and illustrated embodiment of the invention, walls are removably mounted across the guideways on the outer ends of the rams and across the cylinders on the outer ends of the pistons, with the accumulator fluid connecting with the outer ends of the pistons, and the control fluid connecting with the inner ends of the pistons. More particularly, the rods on the pistons extend through the walls of the cylinders, the rods on the rams extend through the walls of the guideways, and yokes connect the outer ends of the rods to one another for shifting within recesses in the body on the outer ends of the continuations. As a result, and as previously described, the outer side of the body may fit closely within the bore of preventer stack, and the rams and pistons may be assembled or replaced merely upon removal of the walls across the guideways and cylinders.

As illustrated, an accumulator chamber is formed in the body vertically of the rams and pistons, and a pressure divider is disposed thereacross with a charge of pressure fluid being contained on one side of the divider and the accumulator fluid which acts between the pistons being contained on the other side of the divider, with suitable conduits in the body connecting with the other side of the divider and the cylinders on the outer side of the pistons.

In accordance with another novel aspect of the present invention, the lower end of the string is releasably connectible to the above described body by means of a body which is connectible to the lower end of the string and having a lower end which is adapted to be lowered into telescoping relation with respect to the upper end of the above described body of the closing means, whereby the bodies are connected with their bores in alignment with one another. The body of the closing means has a locking recess thereabout, and the connector body is landed on the body of the closing means with the telescoping ends of the bodies sealed to one another. The connector body has a series of conduits for receiving control fluid from the source at the surface, and the body of the closing means has a corresponding number of conduits for transmitting the control fluid to different areas within the body of the closing means as well as other areas therebelow. More particularly, the conduits open radially to the telescoping ends of the bodies on generally the same horizontal level, and a means is provided on the bodies for rotationally orienting the connector body into a position in which the ends of its conduits are generally radially aligned with ends of the conduits of the body of the closing means upon lowering of the connector body into landed position, with seal means being provided sealing between the telescoping ends of the bodies in surrounding relation to the aligned ends of the conduits.

In its preferred form, the orienting means includes a pin on one telescoping end, a downwardly facing slot on the other telescoping end for fitting closely over the pin, and a guide surface extending about the other part from one side of the slot to the other and at a relatively small angle with respect to the longitudinal axis of the bodies. Thus, the connector body is moved into proper rotational orientation with respect to the body of the closing means as it is lowered and rotated with the pipe string in a direction to cause it to slide over the guide surface into the slot. This requires only a minimum of vertical space, thereby further adding to the compactness of the apparatus. As will be understood, one or more sets of conduits whose ends are to be aligned may connect with the cylinders between the operating pistons for each set of rams, while still other sets of aligned conduits may extend to other parts of the closing means, or for that matter into the well beneath the closing means.

Locking dogs having lugs thereon are carried by the connector body for radial movement into and out of a locking recess about the upper end of the body of the closing apparatus when the telescoping ends of the connector body is landed on the end of the body of the closing means. More particularly, a locking means is carried by the conductor body for longitudinal reciprocation between positions holding the lugs in locking position and releasing them from locking position, the locking means being urged into locking position by spring means, and an expandable and contractible pressure chamber being formed between the connector body and a piston on the locking means. Thus, conduit means in the connection body connects the chamber with a source of control fluid at the surface which, when supplied to the chamber at a predetermined pressure, overcomes the spring means to move locking means to releasing position.

More particularly, in the event the control fluid is not effective to remove the locking means to releasing position, the lugs may be released in response to manipulation of the well string. For this latter purpose, and in accordance with the illustrated embodiment of the present invention, the connector body includes a first section which is connectible to the pipe string for rotation therewith, a second section which is held against rotation with respect to the body of the closing means and on which the locking dogs and locking means are carried and in which the conduit means in chamber is formed, and means connecting the sections against rotation but releasable in response to rotation of the first section with the pipe string. More particularly, a sleeve is carried by the connector body for longitudinal movement between a first position holding the locking means in locking position, and a second position in which the locking means permits the lugs to move to positions out of the recess. The sleeve is held against rotation with respect to the second section but is longitudinal moveable with respect to the connector body and is threadedly connected to the first section for movement between its first and second positions in response to rotation of the first section with the pipe string in opposite longitudinal directions when released from the second section. In the illustrated embodiment of the invention, the locking means has collet fingers which are opposite the lugs when the locking means is in locking position, and the sleeve moves into and out of positions holding the collet fingers radially outwardly in locking position.

In the drawing, wherein like reference characters are used throughout to designate like parts:

Figure 3A:
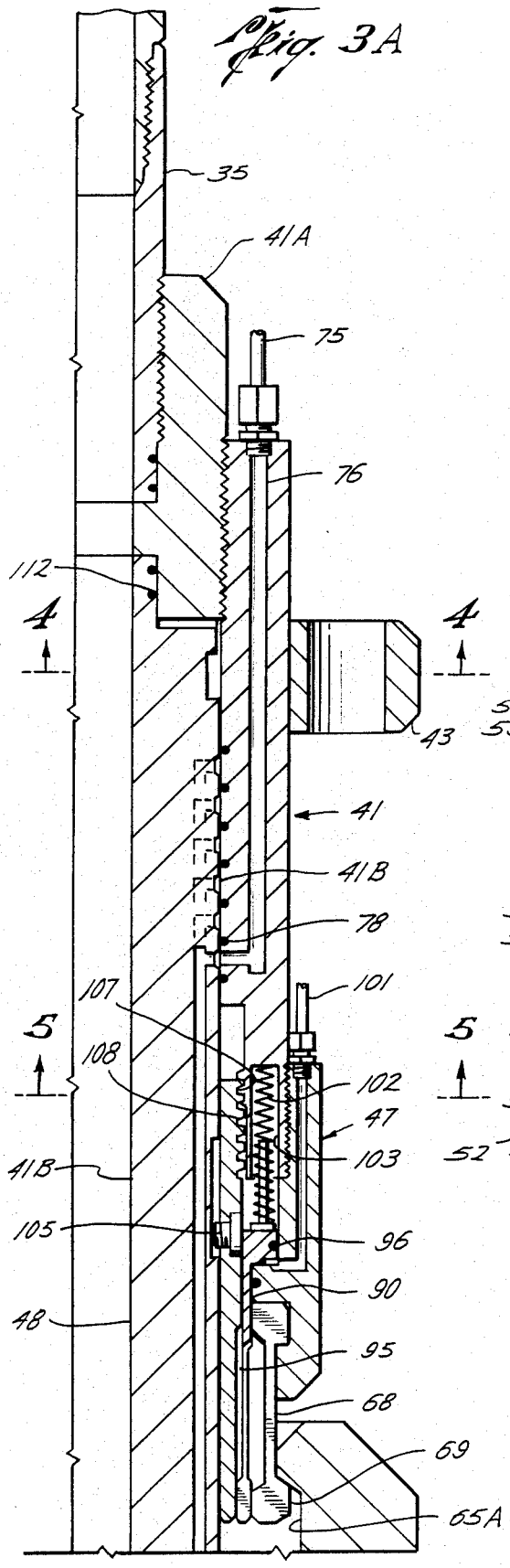
FIGS. 3A and 3B are enlarged vertical half sectional views of the apparatus, including a connector on the lower end of the upper end of the test string connected to the upper end of the body of the closing means.
Figure 3B:
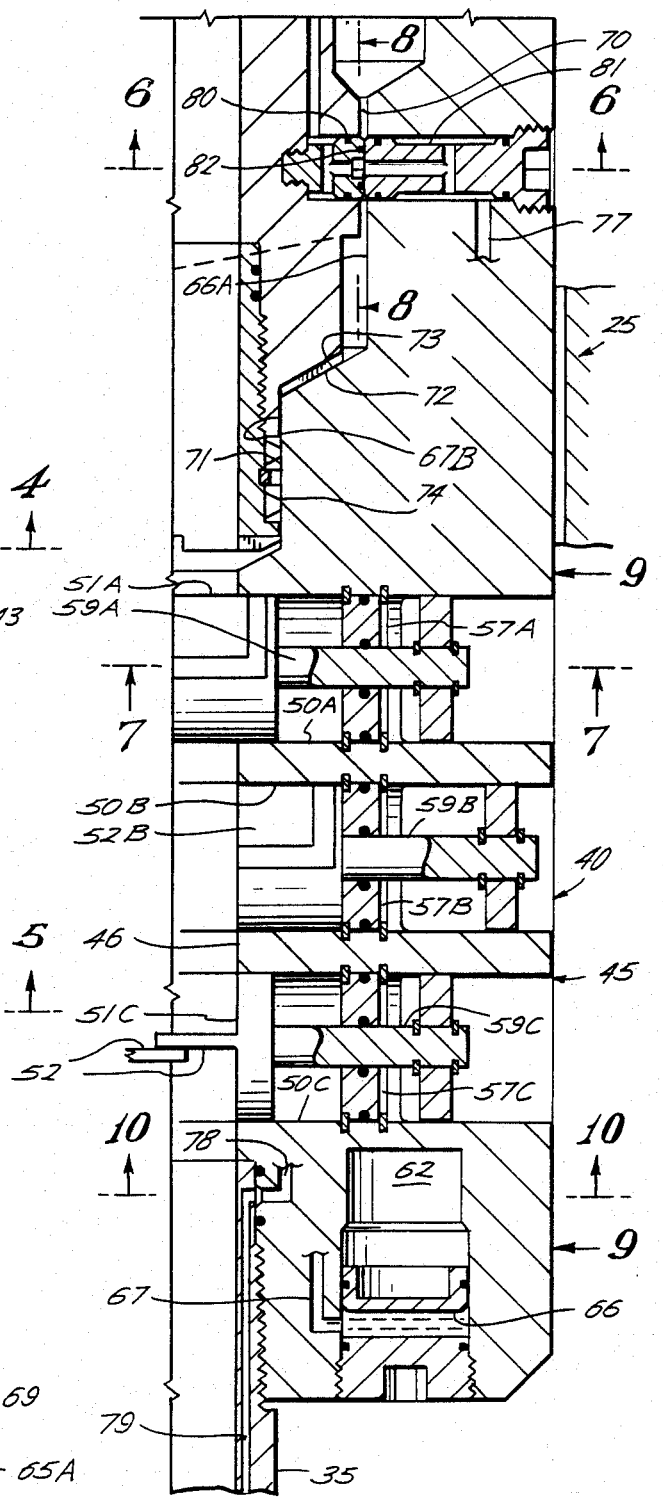
Figure 11:
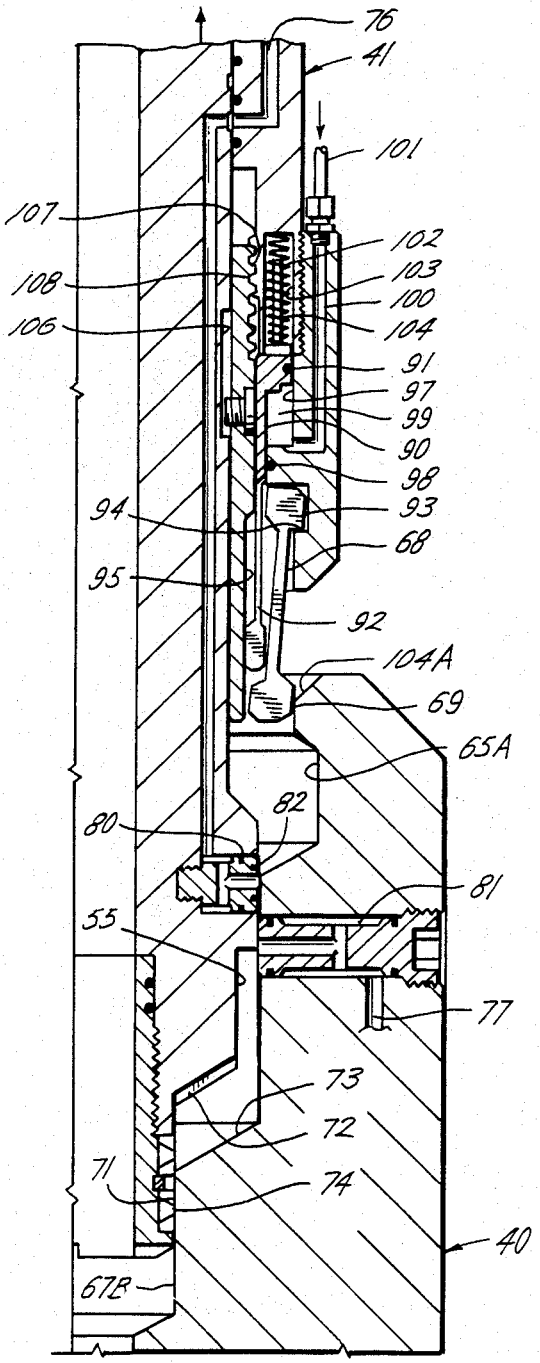
Figure 12:
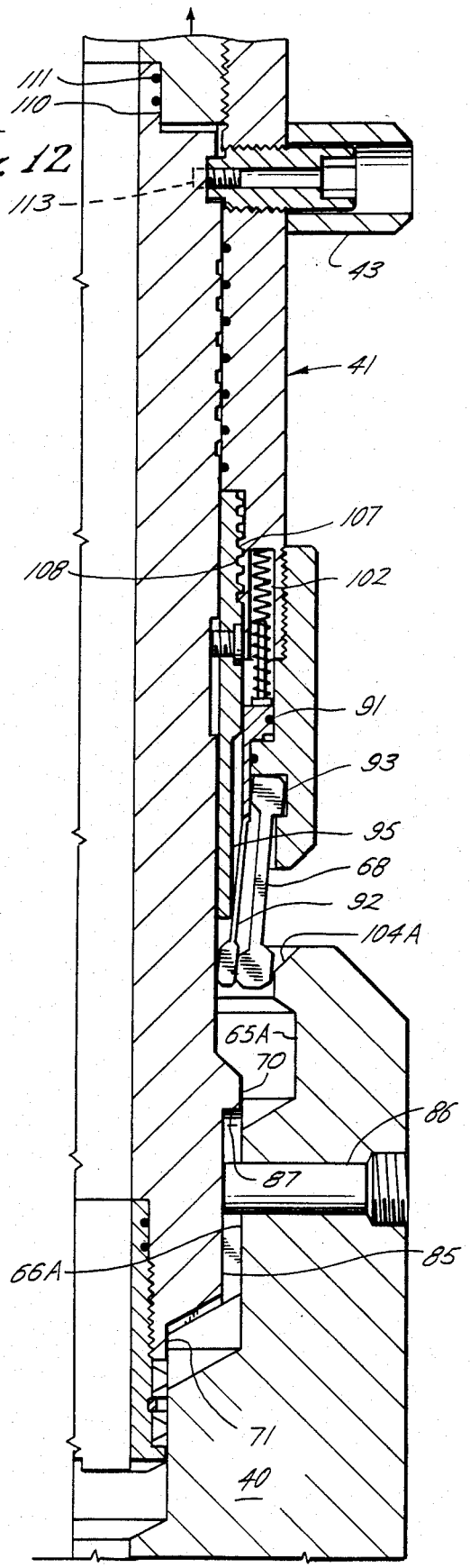

FIG. 11 is a vertical sectional view similar to the lower end of FIG. 3A and the upper end of FIG. 3B, but showing the locking means of the connector body raised in response to control fluid to release the lugs of the locking dogs from a locking recess in the upper end of the body of the closing news, whereby the upper end of the test string may be raised therefrom; and FIG. 12 is a view similar to FIG. 11, but upon raising of the sleeve disposed within the collet fingers of the locking means in response to rotation to the test string in order to permit the collet fingers to move inwardly to release the lugs from the locking recesses so that the connector body may be raised from landed position with respect to the body of the closing means.

Figure 1:
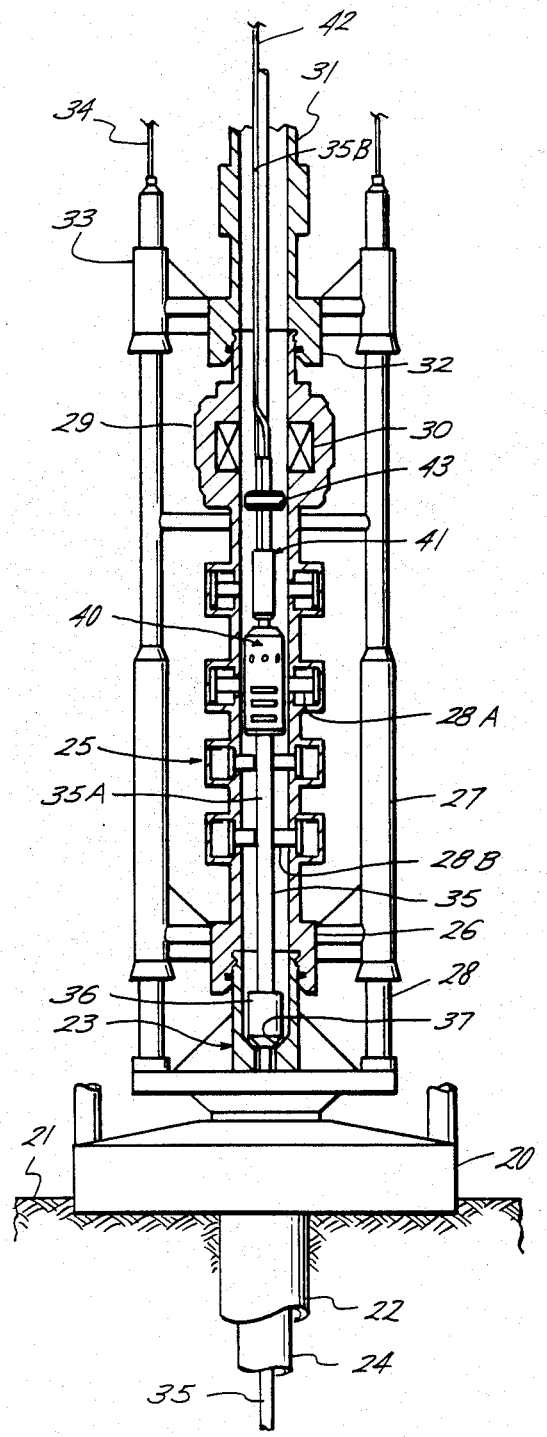
FIG. 1 is a diagrammatic sectional view of apparatus constructed in accordance with the present invention and lowered with a test string into a position within the bore of a blowout preventer stack in which the closing means is beneath the level of the blind runs of the stack, and showing pipe rams of the stack closed on the lower end of the test string beneath the closing means.
Figure 2:
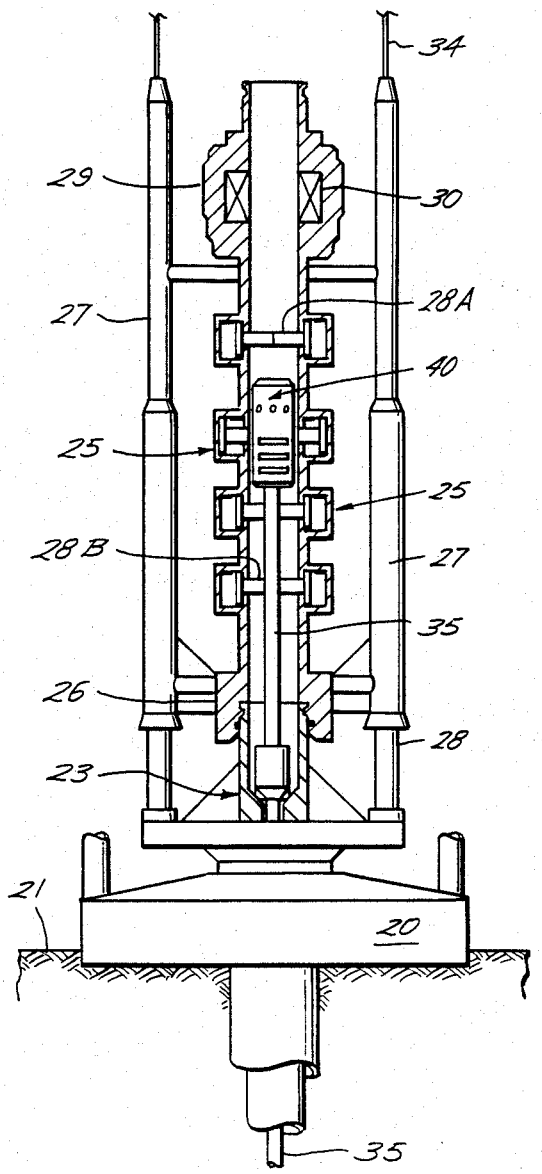
FIG. 2 is a sectional view similar to FIG. 1, but upon release and removal of the connector on the lower end the conductor from the upper end of the blowout preventer stack, release and removal of the upper end of the test string from the closing means, and closing of the blind rams of the blowout preventer stack above the closing means of such apparatus.

With reference now to the details at the above described drawings, the subsea wells shown in FIGS. 1 and 2 comprises a base 20 on the subsea floor 21 and a conductor casing 22 extending downwardly from the base into the well bore. A well head 23 is supported on the base, and an outer casing 24 is suspended from the well head 23 and cemented within the outer casing 22. The lower end of the outer casing 24 is adapted to penetrate a formation to be tested. When the formation has been tested and put on production, remedial work may be performed on the well through suitable lines lowered into the well through the outer casing 24.

A blowout preventer stack 25 is mounted above and forms an upper continuation of the bore though the well head 23 by means of a releasable connector 26 at its lower end. The stack is adapted to be lowered onto and raised from the well head by means of guide members 27 disposed over guide columns 28 extending upwardly from the base 20 to the water surface. The preventer stack 25 includes a plurality of vertically spaced sets of rams mounted within a guideways extending from the bore of the preventer stack. The upper most sets of rams 28A may be of the "blind" type adapted to seal against one another to close an open bore. The lower sets of rams 28B, on the other hand, may be formed with recesses on their inner ends for closing about a pipe string therein, as well be described in detail to follow.

The preventer stack 25 also includes an annular type preventer 29 mounted above the upper most pipe rams and having a bore therethrough forming an upper continuation of the bore through the pipe rams. As well known in the art, the annular preventer includes an annular sealing element or packer 30 which is adapted to seal upon itself when the bore is empty or about an object in the bore.

A conductor casing 31 is releasability connected at it's lower end to the upper end of the annular preventer by means of a releasable connector 32 and forms an upper continuation of the bore through the preventer stack which extends to a drilling vessel at the water surface. The connector on the lower end of the conductor casing is adapted to be lowered onto and raised from the upper end of the preventer stack by means of guide members 33 disposable over the guide columns 27 and adapted to be moved vertically along guidelines 34 extending upwardly from columns 27 to the vessel at the water surface.

As shown in FIG. 1, a test string 35 has been lowered from the water surface into the well bore and through the preventer stack and extends upwardly within the conductor casing to the vessel at the water surface. As previously described, the test string includes a tubular hangar 36 connected to an intermediate portion thereof having a shoulder and adapted to land on a seat 37 in the bore of the well head member 27 so as to suspend the lower end of the string within the outer casing 24. A packer carried by the lower end of the test string is adapted to be packed off within the outer casing 24 above the formation to be tested, or the formation which has been tested and brought into production, as the case may be. The hangar is of the "fluted" type so as to permit well fluid to be circulated upwardly between the seat and the shoulder about the lower end of the hangar 36, as may be required during the testing of the formation and/or remedial operations in the well.

The apparatus for closing the test string, and indicated in its entirety by reference character 40, is connected at its lower end to the upper end 35A of the test string and at its upper end to a releasable connector 41 on the lower end of the upper end 35B of the test string. A bundle of tubes 42 extends downwardly along the side of the upper end of the test string for a connection with conduits in the releasable connector 41, which in turn are connected with conduits within the closure apparatus 40, as will be described in detail to follow. Also, an annular guide member 43 is mounted about the upper end 35B of the test string above the connector 41 so as to center it within the preventer stack.

As shown in FIGS. 1 and 2, when the test string is landed in the well head 23, the upper end of the closing apparatus 40 is beneath the uppermost set of blind rams 28A of the blowout preventer stack 25, and the upper end of the lower end 35A of the test string 35 beneath the closure apparatus 40 includes a "slick joint" which is disposed opposite the lower sets of pipe rams 28B. As shown in FIGS. 1, the upper as well as the next lower set of blind rams of the preventer stack are in open position to accommodate the test string and closure apparatus 40. The pipe rams on the other hand, are moved inwardly to close about the slick joint beneath the closure apparatus 40. As will be understood when the bore of the preventer stack is open—i.e., the test string 35 is not disposed therein—the lower set of blind rams may be closed to provide a redundant means of closing the open bore in the event this is required to control the well.

FIG. 2 illustrates the subsea well of FIG. 1 when a storm or other emergency condition is imminent, such that it is necessary to remove the upper end 35B of the test string 35 from within the well and remove the conductor casing 31 from the upper end of the preventer stack 25 so that the vessel may be moved. Thus, as shown in FIG. 2, connector 41 has been released from the closure apparatus 40 to permit the upper end 35B of the test string to be raised therefrom, and the upper set of blind rams 28A of the blowout preventer stack have been moved to closed position so as to close the wellbore above the closure apparatus. The lower sets of pipe rams remain closed about the slick joint of the lower end of the pipe string beneath the closure apparatus 40 so as to provide complete protection within the well bore outside of the test string. As will be described to follow, rams of the apparatus 40 have been operated so as to close the bore thereof and thus the upper end of the lower end of the test string so as to fully control the well. Furthermore, and as will also be described, in the event remedial work was being performed in the well by means of a line extending through the test string, other rams of the closure apparatus 40 have been operated for shearing the line beneath the rams for closing the bore through the apparatus when the upper end of the sheared line has been raised.

As shown in FIG. 3B, the closure apparatus 40 includes a generally cylindrically body 45 having an outer diameter which is adapted to fit closely within the bore of the preventer stack 25 and a bore 46 therethrough which is adapted to form a continuation of the upper end of the lower end 35A of the test string 35. More particularly the lower end of the bore 46 is threaded to receive the upper threaded end of the slick-joint of the lower end of the test string, and the upper end of the preventer bore is prepared for connection to the lower end of the connector 41. More particularly, the connector includes a tubular body 47 having a lower end adapted to fit telescopically within the upper recessed end of the body 45 and a bore 48 therethrough which, when the connector body and body 45 of the closure appartus are connected, forms an upper continuation of the bore 46. The upper end of the body 47 is threaded for connection with a joint on the lower end of the upper end of the test string 35 so as to form a smooth continuation thereof.

As shown in FIG. 3B, three sets of vertically spaced guideways 50A, 50B, and 50C extend radially outwardly from the bore 46 of the body 45 on opposite sides thereof. As also shown in FIG. 3B, rams 51A, 51B, and 51C are guidably moveable within the guideways 50A, 50B, and 50C, respectively, between outer positions in which they are removed from the bore 46 of the body 45, as in the case of the intermediate rams 51B, and inner positions in which they are disposed across the bore as shown by the upper and lower sets of rams 51A and 51C. As will be described in more detail to follow, in the arrangement shown in the drawings, rams of the closure apparatus 40 are of such construction as to permit a line to be run therethrough for the purpose of performing remedial operations. Hence, the upper rams 51A are of the blind type having flat inner ends (see FIG. 7) for engaging one another to close an open bore, the intermediate rams 51B are "pipe" type rams having recesses formed vertically in their inner faces for closing the bore about a line extending therein, and the lowermost rams 51C are provided with blades 52 which have sharp inner edges for shearing a line beneath the pipe rams.

As previously described, during the performance of remedial work, the blind rams 51A would be open, the shear rams 51C would be moved outwardly to accommodate the line which extends therethrough, and the intermediate pipe rams 51B would be moved inwardly to close the bore about the line, as might be required during the performance of the remedial operation. Then, however, in the event of a storm or other emergency condition in which it was necessary to remove the upper end 35B of the test string from the closure apparatus 40, the shear rams 51C would be moved inwardly to shear the line, the pipe rams 51B would be opened, and the upper end of the line raised above the blind rams 51A to permit them to be moved inwardly to close the well bore and thus control the well. At this time, of course, the connector 41 could be released from the closure apparatus 40 and lifted from within the conductor.

Alternatively, during the testing of the formation of the well, all of the rams would, under normal circumstances, be in their open positions. Should it be necessary to remove the upper end of the test string at this stage, it is merely necessary to close the blind rams to close off the bore of the apparatus prior to removal of the upper end 35B of the test string. In certain cases where remedial work is not anticipated, all rams may be of the blind type, the lower sets of rams providing redundant protection for controlling the well. It's also possible that the remedial work may be performed by a thin flexible line on which blind rams could close, in which case the intermediate pipe rams may not be required, and could instead comprise a redundant set of blind rams. It's also contemplated that the operator of the well would not anticipate emergency conditions, and would therefore not use a set of shear rams. In this case, the upper sets of rams could be blind rams, and the lower set pipe rams for closing about the line extending through the bore of apparatus 40 for remedial purposes. It will also be understood, that the apparatus 40 may be pulled upwardly from the well bore, along with the test string, to permit one or more sets of rams to be changed from one type to another, depending upon the operations to be performed within the well.

Each of the blind and pipe rams is of conventional construction in that it comprises a body adapted to fit closely within its guideways, and packing which extends across the face of the body for engaging the face packing of the body of the opposing ram, along the sides of the body rearwardly from the ends of the face packing, and over the top of the ram body to connect the outer ends of the side packing. As shown, the top packing remains in the guideway when the ram is closed so that, as well known in the art, the pressure of well fluid beneath the closed rams provides a force urging them closed.

Figure 7:
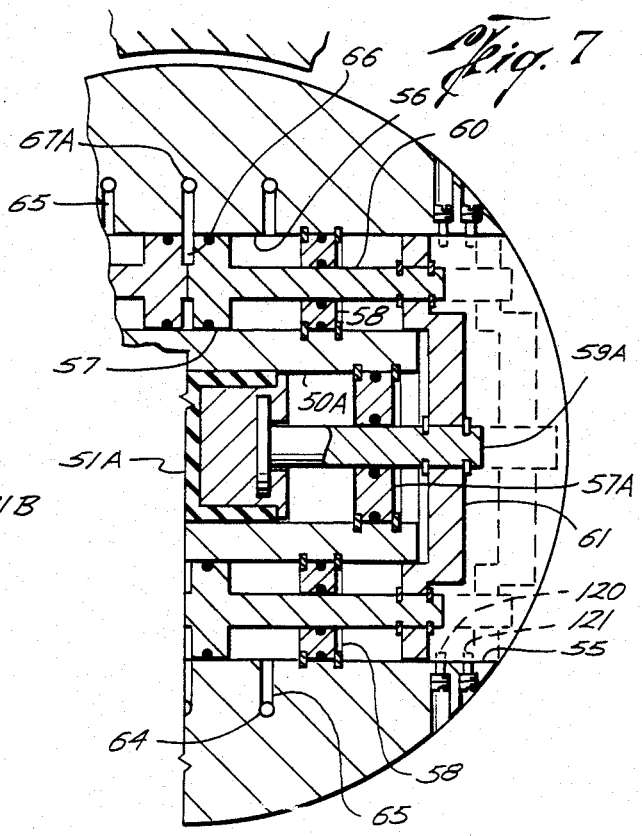
FIG. 7 is a cross sectional view of the body of the closing means, as seen along broken lines 7—7, including the cylinders and pistons on opposite sides of the guideways and rams, as well as the means for connecting the pistons to the rams.
Figure 8:
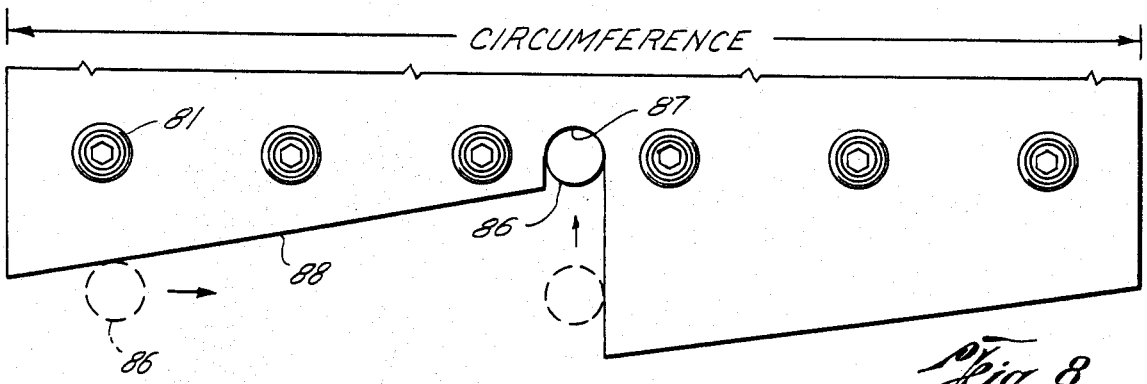
FIG. 8 is a developed view of the outer side of the telescoping lower end of the connector body, as seen along broken lines 8—8 of FIG. 3B, including a slot movable over a pin on the telescoping end of the body of the closing means to rotationally orient the connector body with respect thereto.
Figure 9:
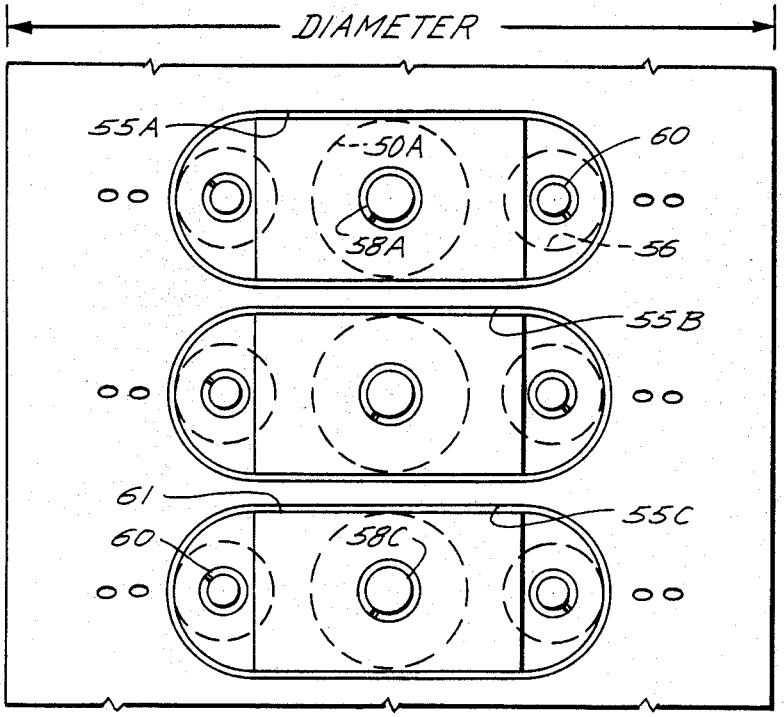
FIG. 9 is a developed view of one outer side of the apparatus body, as seen along broken lines 9—9 of FIG. 3B.

As shown in FIG. 3B, and as illustrated in FIG. 7 in connection with the upper set of blind rams 51A, the guideways for each set of rams have outer continuations which connect with the outer side of the body 45. More particularly, and as can be seen from FIGS. 7 and 9, the outer continuations of the guideways connect with the central part of an oblong recess 55 formed in each opposite side of the body 45. As indicated in broken lines in FIG. 7, cylinders 56 are formed in the body 55 on opposite sides of and on generally the same horizontal level as the ram guideways. More particularly, a piston 57 is sealably slideable within each cylinder 56 for reciprocation along a path parallel to the path of reciprocation of the rams within their guideways.

Walls 57A, 57B and 57C are removeably mounted across the ends of the guideways, and the opposite ends of the cylinders are closed by means of walls 58 removeably mounted thereacross. More particularly, rods 59A, 59B, and 59C are connected at their inner ends to the rams and sealably slideable through holes in the outer walls across the guideways, and in like manner, rods 60 extend from the outer sides of each of the piston and through holes in the walls 58 across the outer ends of the cylinders. As best shown in FIG. 7, the outer ends of the rods connected to the rams and the rods connected to the cylinders are connected to one another by means of yokes 61, and, in these respects the overall arrangement and construction of the rams and pistons is similar to a blowout preventer marketed by Texas Oil Tools of Hiuston, Texas. However, in accordance with the present invention, the yokes are disposed within the recesses 55 for reciprocation between an inner position when the pistons are moved inwardly to move the rams to closed position, and an outer position shown in broken lines (FIG. 7) when the pistons are moved outwardly to withdraw the rams from the bore of the body 45.

As shown in FIGS. 3B and 7, each of the guideway and piston walls is removeably mounted and sealed within the guideway or cylinder by means of snap rings. In this way, the snap rings may be released and the walls moved outwardly through the continuations of the guideways and cylinders so as to permit the rams and pistons to be moved through the continuations of the guideways and cylinders for purposes of assembly and replacement.

Figure 10:
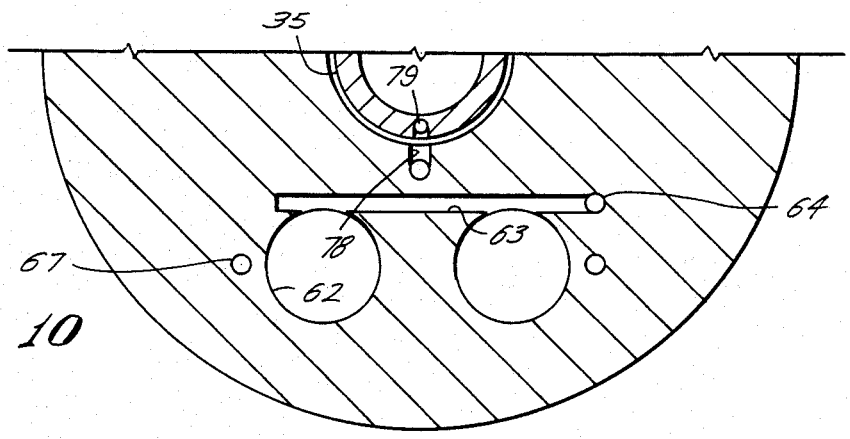
FIG. 10 is still another cross sectional view of the body of the closing means, as seen along broken lines 10—10 of FIG. 3B.

The pistons 57 are urged inwardly toward one another, and thus the rams to which they are connected are urged toward closed positions, by air or other gas accumulated within chambers of 62 formed within the body beneath the lower set of rams. As shown in FIG. 10, two such chambers which are connected to one another by a laterally extending conduit 63 which in turn is connected to the cylinders on the outer sides of the pistons by means of conduit 64 extending upwardly from the lateral conduit 63 and connecting with lateral conduits 65 leading to the cylinders on the outer sides of the pistons. Thus, as shown in FIG. 7, the accumulator pressure urges the pistons inwardly to urge the blind rams 51A to the closed positions shown in FIGS. 3B and 7. If desired, the same accumulators 62 may also connect with the cylinders on the outer sides of the pistons connecting with all sets of rams. Alternatively, one or more sets of rams may be urged inwardly by different accumulators.

As shown, each accumulator chamber 62 has a piston 66 sealably slideable in its lower end to divide it into an upper portion in which the accumulator gas is contained and a lower portion into which a charge of pressure fluid is introduced to maintain the accumulator pressure at a desired level. As shown in FIG. 3B, a conduit 67 extending vertically downwardly through the valve body 45 connects at its lower end with the chamber beneath the piston 66 so as to permit a suitable charge to be supplied thereto from a source at surface level.

The pistons are adapted to be moved outwardly so as to in turn move the rams to which they are connected to open positions by means of a source of pressure fluid supplied from the surface to the cylinders intermediate the pistons. This control fluid is admitted to the cylinders though a lateral conduit connecting with a vertical conduit 67A which, as will be described to follow, extends through the body 45 for connection with a conduit extending through the connector, and thus with a tube of the tube bundle extending downwardly to connection with the conduit in the connector body. As will be appreciated, this control pressure must be supplied at a pressure sufficient to overcome the accumulator pressure in order to maintain the rams to which the pistons are connected in open position.

Accumulator pressure, and thus control pressure, may be relatively small due to the relatively small force necessary to urge the rams inwardly toward closed position. Thus, as previously described, the only force due to well pressure which need be overcome by the accumulator pressure is that which acts over the cross sectional areas of the rods 59A, 59B, and 59C connecting the rams to the yokes. As previously described, the control pressure may be exhausted to permit the pistons to move inwardly toward one another and thus cause the rams to move to closed positions. Also, the seals of the pistons 66 need not contain different pressure between the well fluid and control fluid, but rather the small differential between control fluid and accumulator fluid necessary to move the pistons.

The upper recessed end of the body 45 includes an enlarged upper diameter portion having a locking recess 65A, an intermediate diameter portion 66A, and a lower most diameter portion 67B. Locking dogs 68 having lugs 69 on their lower ends are carried by the body of the connector 41 for movement into and out of positions opposite the recess 65A, and lower cylindrical portions of the body depend from the locking dogs for fitting relatively closely within the intermediate and lower diameter portions 66A and 67B of the recess in the body 45. Thus, an upper diameter portion 70 of the lower end of the connector body is adapted to fit closely within the intermediate diameter portion 66A of the body 45, and a lowermost outer portion 71 of the connector body is adapted to fit closely within the lowermost portion 67B of the recess of the body 45.

More particularly, a downwardly facing annular shoulder 72 about the connector body intermediate the diameter portions 70 and 71 is adapted to land on an upwardly facing seat 73 in the recess of the upper body intermediate diameter portions 66 and 67. As shown in FIG. 3B, this shoulder 72 is fluted. When the connector body is so landed on the body 45 of the closure apparatus 40, it is sealed with respect thereto by means of a seal assembly 74 carried about the outer diameter portion 71 to form a sliding seal with diameter portions 67B of the recess in the body 45. As will also be seen from FIG. 3B, when the connector body is so landed on the body 45, the lugs 69 of the locking lugs 68 may be forced outwardly to dispose shoulders about the upper ends of lugs 69 beneath the upper tapered end of the locking recess 65A in the body 45, so that there is little or no slack in the connection.

Figure 6:
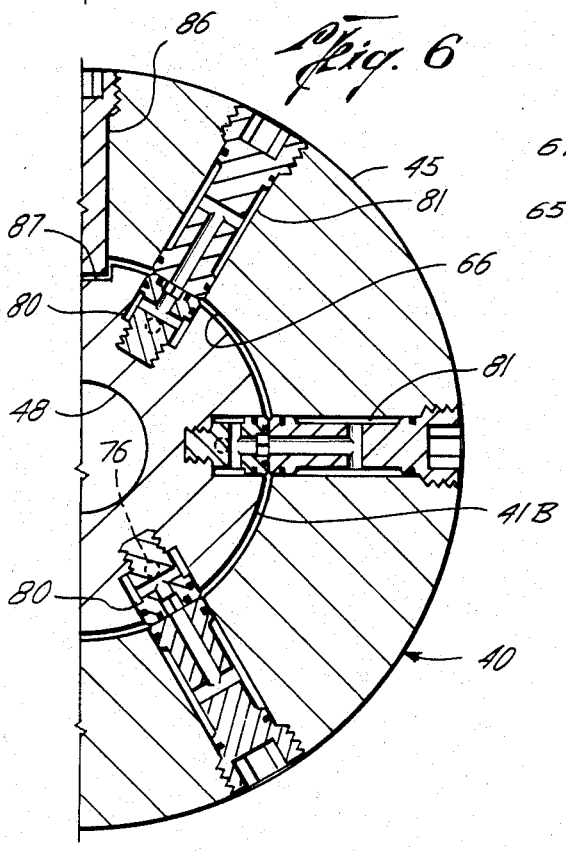
FIG. 6 is still another cross sectional view, as seen along broken lines 6—6, but showing the telescoping lower and upper ends, respectively, of the connector body and the body of the closing means.

The tube bundle 42 includes six tubes 75, three of which extend downwardly from the source of control fluid at the surface level for operating the three sets of rams, a fourth from a source of charging fluid for the accumulator, and a fifth from a source of chemical or other substance to be injected into the well. Each such tube is connected at its lower end to a separate conduit 76 extending vertically downwardly through the connector body 41 for connection at its lower end with the upper end of another conduit 77 formed in the body 45 of the closure apparatus. Each of the three of the conduits 77 thus connects with conduit 67A (FIG. 7) leading to the space between pistons 57, and a fourth conduit 77 connects with conduit 67 leading to the lower side of accumular piston 66 (FIG. 6B).

The fifth conduit 77 connects with a conduit 78 leading to a further conduit 79 extending downwardly through the slick joint of the lower end of the test string 35, as shown in FIG. 3B. If desired, suitable chemicals may be circulated downwardly through this conduit 77 and thus through the conduit 79 to a location within the well bore. Thus, it is contemplated that the conduit 79 will connect with other conduits extending through the hangar 36 leading to the annular space about the test string. The sixth conduit 77 may be used for whatever reasons might arise.

Figure 4:
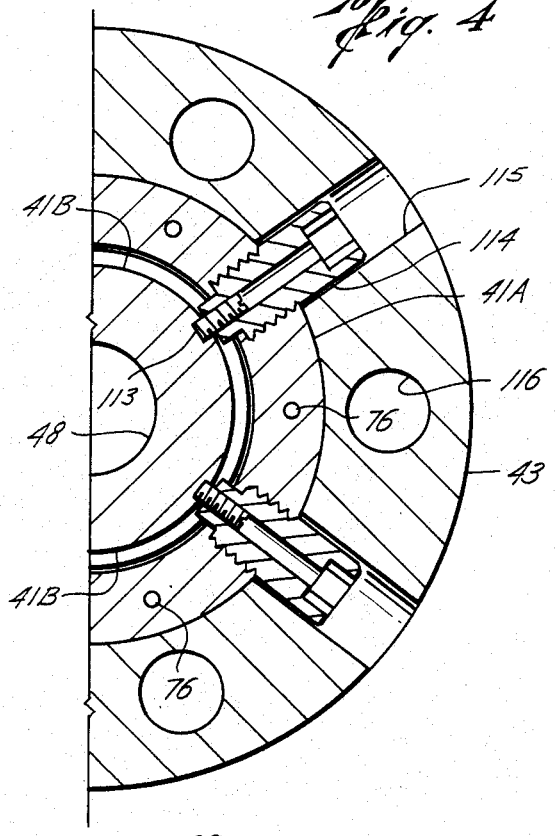
FIG. 4 is an enlarged cross sectional view of an upper portion of the connector, as seen along broken lines 4—4 of FIG. 3A.
Figure 5:
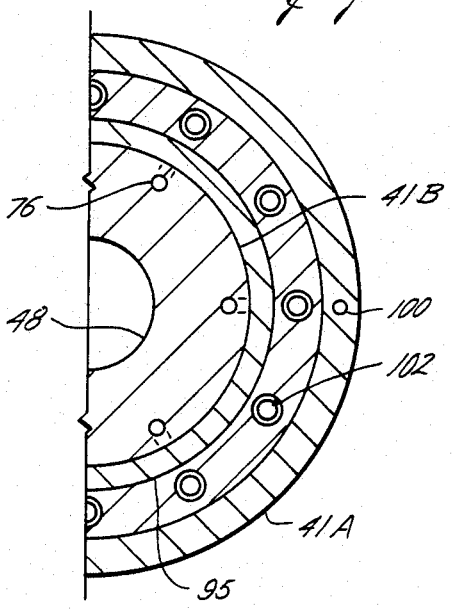
FIG. 5 is another cross sectional view of the connector, as seen along broken lines 5—5 of FIG. 3A.

Body 41 of the connector 40 is made up of a first section 41A which is threaded for connection with the lower end of the upper end 35B of the test string 35, and a second section 41B which is relatively rotatable with respect to the first section 41A and forms the lower end of the connector body telescopicably disposable within the recess in the upper end of the body 45. Each of conduits 76 includes an upper end extending through the first section of 41A and a lower end extending through the section 41B for connection with a conduit 77 in the body 45. More particularly, the lower end of each of the upper ends of the conduit 76 has a lateral portion which connects with the inner diameter of the section 41A at a vertical level spaced from that at which lateral portions of the other conduits 76 connect therewith. In like manner, the upper ends of the lower portions of the conduits 76 formed in the section 41B of body 41 have lateral projections which connect with the outer diameter of section 41B on different vertical levels. The lateral projections of the upper and lower conduit portions of each conduit 76 are fluidly connected with one another, but are separated from those of the other conduits 76 by means of seal rings 78 which are carried about the inner diameter of the section 41A to form separate annular portions between sections 41A and 41B. As will be understood, and as shown in FIGS. 4 and 5, each of the upper and lower portions of the separate conduits 76 are spaced circumferentially about the first and second sections of the connector body 41.

In accordance with one novel aspect of the present invention, when the connector body is landed in rotationally oriented position with respect to body 45, the lower end of the lower portion of each conduit 76 is fluidly connected to the upper end of a conduit 77 on substantially the horizontal level, thereby enabling a compact connection of the lower end of the connector body to the upper end of the body 45. For this purpose, the lower ends of the lower portions of the conduits 76 connect with plugs 80 mounted in lateral openings in the portion 70 of the lower end of the connector body, and the upper ends of the conduits 77 connect with plugs 81 mounted in lateral openings in the portion 66A of the upper end of the body 45. More particularly, and as shown in FIG. 3B, as the connector body is rotationally oriented upon landing on body 45, lateral ports in the plugs are generally radially aligned with one another and fluidly connected by means of an o-ring 82 on the outer face of the plug 80 which sealably engages the outer face of the plug 81 in surrounding relation to their aligned radial ports. As will be appreciated, the plugs may be easily removed to enable seal rings defining the flow paths between conduits 76 and 77 to be replaced as needed.

In order to radially orient the connector body, and thus align the plugs, to fluidly connect the conduits 76 and 77, the intermediate diameter portion 70 of the lower end of the connector body is provided with a recess 85 adapted to be moved downwardly onto the inner end of a pin 86 mounted on the upper end of the body 45 and extending into the diameter portion 66 thereof. More particularly, the recess includes a downwardly facing slot 87 adapted to be moved closely over the upper end of the pin 86 and having the opposite lower ends of the slot spaced vertically from one another, and a guide surface 88 at the upper end of the recess which extends at a relatively small angle from one end of the slot to the other. Thus, the weight of the connector body will orient it into position in which the slot moves down over the pin as the guide surface 88 slides over the pin, regardless of the rotational position of the lower end of the connector body with respect to the body 45 as it first engages the pin.

As the connector body is lowered into connected position with body 45, it may be continually rotated in a clockwise direction, looking in a direction downwardly, as its lower end is moved into telescoping relation with respect to the recess in the upper end of the body 45. As a result, regardless of which part of the guide surface 89 first engages the aligning pin 86, the connector body is free to continue to move downwardly as it is slowly rotated in a clockwise direction until the slot 87 is above the pin 86, at which time the connector body will move vertically downwardly until the upper end of the slot 87 engages the top side of the pin 86. Alternatively, the connector body may be lowered without rotating until the guide surface engages the orienting pin, and then rotated to the right until the slot is aligned with the guide pin and then lowered to move the slot down over the guide pin.

As shown in each of FIGS. 3A, 11 and 12, the upper ends of the locking dogs 68 are carried within a groove 94 in an internally recessed portion of the connector body so that they may tilt between positions in which the lugs 69 thereof move between an locking position within locking recess (FIG. 3A) and an unlocking position out of the recess (FIGS. 11 and 12). The means for so moving the lugs comprises a locking member 90 comprising an upper ring 91 carried within a recess in the first section 41A of the connector body and collet fingers 92 carried by the ring for disposal within the locking dogs. As shown, the locking member 90 is longitudinally moveable with respect to the connector body between the lower position of FIG. 3A, in which the lower ends of the collet fingers are disposed within the inner sides of the lugs 69, and an upper position, as shown in FIG. 11, wherein the lower ends of the collet fingers are above the lugs so as to permit the lugs to move inwardly to unlocking position upon swinging of the locking dogs about their upper supported end 93 carried within internal groove 94.

The means for operating the locking dogs further comprises a sleeve 95 also carried within the recess of the first section 41A on the inner side of locking member 90 for longitudinal movement with respect thereto between the lower position of FIGS. 3A and 11 and the upper position of FIG. 12. In its lower position, the lower end of sleeve 95 is disposed within the lower ends of the collet fingers 32, when the locking member 90 is in the lower position of FIG. 3A, so as to hold the lugs 69 of the locking dogs 68 in an outward locking position. However, upon raising of the locking member 90 to its upper position, as shown in FIG. 11, the lugs 69 are free to move inwardly to unlocking positions even though the sleeve 95 is in its lower position. As shown in FIG. 12, when the locking sleeve 95 is in its upper position, the lower ends of the collet fingers are free to be flexed inwardly, even though locking member 90 is in its lower position, so that the lugs may be cammed inwardly by the upper end of the locking recess 65 upon raising of the connector body. The ring 91 on the upper end of locking member 90 carries a seal ring 96 which is sealably slideable along the inner diameter of the portion 97 of the recess of the first section 41A of the connector body above the annular groove 94 in which the upper ends of the locking dogs are received. The lower reduced diameter portion of the ring is sealably slideable within a seal ring 98 carried by a reduced diameter portion of the recess in the inner section 41A of the connector body intermediate groove 94 and the recess portion 97. Thus, the enlarged upper end 91 of the locking member serves as a piston which is sealably slideable within the recess portion 97 to form an expandable and contractible chamber between the lower side of the piston and the upper side of the reduced diameter portion of the recess in section 41A. This chamber is in turn connected to a conduit 100 formed in the section 41A of the connector body and connected at its upper end to a tube 101 which forms part of the tube bundle 42 and thus connects with a source of pressure fluid at the surface.

The piston and thus the locking member 90 is urged to the lower position of FIGS. 3A and 12 by means of a coil spring 102 carried within circumferential spaced spring chamber 103 (see FIG. 5) formed in the connector body above the recess portion 97. Each spring surrounds a rod 104 which provides a spring guide and acts between the upper end of spring chamber and the piston of the locking member 90 so as to normally urge the locking member 90 downwardly to the lower position of FIGS. 3A and 12. Thus, the supply of control fluid through the tube 101 and conduit 100 to the chamber 99 is adapted to urge the piston and thus the locking member 90 upwardly to compress the spring. In order to lower the connector into connected position within the recess in the upper end of body 45 of the closure apparatus, control fluid is therefore supplied to the chamber 99 to raise the locking member 90 to the position shown in FIG. 11, so that the lower ends of the lugs 69 on the locking dog 68 will be cammed inwardly by the upwardly and outwardly tapered shoulder 104A on the upper end of the body 45 above locking recess 65, as the connector body is lowered toward landed position, and thus moved downwardly into a position opposite the locking recess 65 as shoulder 72 on the connector body lands upon seat 73 in the body 45. At this time, the pressure of the control fluid may be exhausted to permit the spring 102 to urge the locking member 90 downwardly and thus into a position in which the lower ends of the collet fingers 92 move within the inner sides of the lugs 69, to cam them outwardly. At this time, sleeve 95 is in its lower position, so that, as shown in FIGS. 3A and 11, the lower ends of the collet fingers are held outwardly to maintain the lugs 69 in locking position.

When it is desired to disconnect the connector body from the body 45, pressure of the control fluid is again raised so as to lift the piston 91 and thus the collet fingers 92 from within the lugs 69. This then permits the lugs to be cammed inwardly to unlocking position by the upper end of recess 65 as the connector body is raised upwardly with respect to the body 45.

As previously described, however, the fluid responsive operating means above described may become inoperative and thus not enable release of the lugs 69, as, for example, due to a break or leak in the tube 101. In order to release the lugs from locking position in this instance, a means is provided for mechanically lifting the sleeve 95 from its lower to its upper position of FIG. 12 in response to manipulation of the test string at the surface. Thus, as shown in FIG. 12, and previously described, lifting of the sleeve enables the lower ends of the collet fingers 92 to be swung inwardly as the lugs 69 are cammed out of the locking groove 65 upon raising of the connector body.

For this purpose, the holding sleeve 95 is provided with a pin 105 vertically slidable within a slot 106 formed in the outer diameter of the connector body section 41B opposite the recess in which the holding sleeve is contained. As a result, the sleeve is free to move longitudinally or vertically with respect to the body section 41B, but is held against rotation therewith. More particularly, the upper end of the outer diameter of the sleeve is provided with threads 107 which are engaged with threads 108 on the upper end of the recess in body section 41A in which the upper end of the sleeve is received. Since the section 41B of the connector body is held against rotation by means of the pin 86 within the slot 87, rotation of the first section 41A of the connector body by means of test string will, through the threads 107 and 108, cause the sleeve 95 to be mechanically moved upwardly to its position of FIG. 12 in which its upper end engages the upper end of the recess in connector body section 41A. Thus, as previously described, the lower ends of the collet fingers 92 are free to be moved inwardly by the lugs 96 as the lugs are cammed upwardly along the upper tapered end of the locking recess in response to raising of the connector body with respect to the body 45.

As shown in each of FIGS. 3A and 12, the upper end of first section 41A of the connector body has a recess 110 formed therein which is rotatable within an upper extension 111 on the upper end of second body section 41B. More particularly, seal rings 112 are carried by the upward extension to form a sliding seal between the first and second sections of the connector body. The sections 41A and 41B are normally held against rotation so as to prevent accidental lifting of the holding sleeve 95 which might inadvertently release the lugs 69. For this purpose, and as shown in FIG. 4, a series of shear screws 113 carried by plugs 114 mounted within threaded holes through the connector body section 41A laterally into oppositely disposed threaded holes in the adjacent face of section 41B. More particularly, and as also shown in FIG. 4, the plugs 114 are moved into and out of threaded engagement with first body section 41A through holes 115 formed in the guide 43 intermediate bypass ports 116 therein, thereby supporting the guide from the connector body and protecting the outer ends of the plugs from damage. In any event, upon the application of sufficient torque to the upper end of the test string, screws 113 are sheared to permit the connector body section 41A to be rotated with respect to the second body section 41B in order to lift the holding sleeve 95 to the upper position of FIG. 12.

Upon release of the connector from the closure apparatus by the emergency release mechanism above described, and raising of the connector body to the surface, the connector can be prepared for reconnection by reverse rotation of the body section 41A so as to lower the sleeve 95, and replacement of the shear screws 113 by removal of the parts 114 through holes 115 formed in the guide 43. Then, upon repair of the control fluid tube 102, the operating means is again ready for the supply of control fluid to the chamber 99 sufficient to raise the locking member 90 and thus remove the lower ends of the collet fingers from within the inner sides of the lugs 69, so that the lugs are free to be cammed into a position opposite the locking groove of the body 45 as the connector body is lowered back into connection with the body 45.

The inner edges of the shear rams 52 are preferably skewed with respect to one another so as to move a pipe or other line within the bore of the body 45 into an axial position within the bore 46 as the shear rams are caused to move to closed position. That is, each such inner edge forms a slight angle with respect to a plane perpendicular to the axis of movement of the shear rams, whereby the opposite side edges of the blades will overlap one another to form a decreasing opening between them as the shear rams are moved to closed position.

As indicated in FIG. 7, shear pins 120 and 121 may be mounted in the side of the recess in which the yoke connecting the shear rams and its operating pistons is moveable. More particularly, the outer shear pin 121 is so located as to be on the inner side of the inner side edge of the yoke to releasably hold the yoke in a position to hold the shear rams open. This is useful, for example, in the event it is desired to release the shear rams to move to shearing positions only in the event they are urged toward that position by higher than normal accumulator pressure. Thus, assuming that all of the rams are urged to closed positions by the same accumulator pressure, the shear rams would be so moved only in the event a booster accumulator pressure was applied to the lower end of chamber 62 through the conduit 67 which is sufficiently high to shear the pins 121. The inner shear pins 120, on the other hand, are so located as to enable the shear rams to be urged inwardly by accumulator pressure to an intermediate position in which they will center the pipe or other line within the bore of the preventer body 45, but not shear it until the application of a booster pressure to the dividing piston in the lower end of the accumulator chamber 62.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanyng drawings is to be interpreted as illustrative and not in a limiting sense.

The invention having been described, what is claimed is:

1. For use in performing operations within a subsea well by means of a pipe string which is lowered through a conductor depending from a drilling vessel at the water surface and releasably connected at its lower end to a blowout preventer stack, said string having means for landing upon the head of the well on which the stack is mounted for depending therefrom into the well bore, apparatus for selectively closing the string so as to maintain control over the well upon raising of the upper end of the string thereabove, said closing apparatus including a body having a bore therethrough which is connectible at its lower end to the lower end of the string and means at its upper end releasably connectible to the upper end of the string for raising and lowering with the string into and out of a position within the bore of the stack, guideways in the body extending from the bore therethrough, rams slidable in the guideways between positions opening the bore of the body and closing the bore, cylinders in the body, pistons reciprocable in the cylinders and connected to the rams for moving them between opened and closed positions, and means responsive to the supply and exhaust of control fluid from a source at the surface level for causing the pistons to move the rams between opened and closed positions.

2. Apparatus of the character as defined in claim 1, including continuations of the guideways and cylinders which extend through the outer side of the body and through which the rams and pistons may be moved into and out of the guideways and cylinders.

3. Apparatus of the character as defined in claim 1, wherein there are at least two sets of vertically spaced guideways, with the rams in one set of guideways being constructed to close upon an open bore, and the rams in the other set of guideways being constructed to shear a line in the bore.

4. Apparatus of the character as defined in claim 1, wherein there are at least two sets of vertically spaced guideways, with the rams in one set of guideways being constructed to close an open bore, and the rams in the other set of guideways being constructed to close about a line in the bore.

5. Apparatus of the character as defined in claim 4, wherein there is a third set of guideways vertically spaced from the other sets, with the rams in said third set being constructed to shear a line in the bore.

6. For use in performing operations within a subsea well by means of a pipe string which is lowered through a conductor depending from a drilling vessel at the water surface and releasably connected at its lower end to a blowout preventer stack, said string having means for landing upon the head of the well on which the stack is mounted for depending therefrom into the well bore, apparatus for selectively closing the string so as to maintain control over the well upon raising of the upper end of the string thereabove, said closing apparatus including a generally cylindrical body having a bore therethrough which is connectible at its lower end to the lower end of the string and means at its upper end releasably connectible to the upper end of the string for raising and lowering with the string into and out of a position within the bore of the stack, guideways in the body extending from the bore therethrough, rams slidable in the guideways between positions opeining the bore of the body and closing the bore, cylinders in the body extending parallel to and on opposite sides of the guideways, pistons mounted for reciprocation in the cylinders and connected to the rams for moving them between opened and closed positions, and means responsive to the supply and exhaust of control fluid from a source at the surface level for causing the pistons to move the rams between opened and closed positions.

7. Apparatus of the character as defined in claim in 6, including continuations of the guideways and cylinders which extend through the outer side of the body and through which the rams and pistons may be moved into and out of the guideways and cylinders.

8. Apparatus of the character as defined in claim 6, wherein the means for causing the pistons to move includes means within the body for containing a source of fluid under pressure which connects with the cylinders on one side of the pistons to urge the rams toward closed position, and means in the body connecting with the cylinders on the other side of the pistons for supplying or exhausting the control fluid with respect thereto at a pressure which holds the rams open as long as such pressure is maintained.

9. Apparatus of the character defined in claim 8, including continuations of the guideways and cylinders which extend through the outer side of the body, walls removably mounted across the guideways on the outer ends of the rams and across the cylinders on the outer sides of the pistons, the fluid contained within the body being on the outer ends of the pistons, and the control fluid being on the inner ends of the pistons, rods on the pistons extending through the walls of the cylinders, rods on the rams extending through the walls of the guideways, and yokes connecting the outer ends of the rods to one another and shiftable within recesses in the body on the outer ends of the continuations, said walls, upon removal, enabling the rams and pistons to be moved into and out of the guideways and cylinders through the continuations thereof.

10. Apparatus as defined in claim 9, including chamber means in the body spaced vertically of the rams and pistons and having a pressure divider therein, a charge of pressure fluid being contained on one side of the divider and the fluid source being contained on the other side of the divider, and conduits in the body connecting the other side of the divider with the cylinders on the one side of the pistons.

11. Apparatus as defined in claim 6, wherein there are at least two sets of vertically spaced guideways, with the rams in one set of guideways being connstructed to close upon an open bore, and the rams in the other set of guideways being constructed to shear a line in the bore.

12. Apparatus as defined in claim 6, wherein there are at least two sets of vertically spaced guideways and cylinders, with the rams in one set of guideways being constructed to close an open bore, and the rams in the other set of guideways being constructed to close about a line in the bore.

13. Apparatus as defined in claim 12, wherein there is a third set of guideways and cylinder means vertically spaced from the other sets, with the rams in said third set being constructed to shear a line in the bore.

14. Apparatus for releasably connecting the lower end of a pipe string to a well conduit disposed within a well bore, comprising a body connectible to the lower end of the pipe string and having a first cylindrical part adapted to be lowered into close fitting, telescoping relation with respect to a second cylindrical part on the well conduit, means for landing the body on the well conduit and sealing between and latching the telescoping parts to one another, when the body is so landed, the body having a series of conduits for receiving control fluid from a source at the surface, the well conduit having a corresponding number of conduits for transmitting such control fluid to different areas within the well conduit, the conduits opening substantially radially to the telescoping parts of the body and well conduit on generally the same horizontal level, means on said body and well conduit for rotationally orienting the body about the vertical axes of the first and second parts into a position in which the ends of its conduits are generally aligned with the ends of the conduits of the well conduit upon lowering of the telescoping part of the body into landed position with respect to the telescoping part on the well conduit, including a surface about the circumference of one telescoping part and a pin on the other telescoping part which are movable vertically into engagement with one another, as the body is so lowered, said surface having a shoulder thereon and extending circumferentially between the upper and lower portions of the shoulder at a relatively small angle with respect to the horizontal, whereby said shoulder and pin are engageable, upon rotation of the body with the pipe string about said vertical axes following engagement of the surface and pin, so as to locate said body in said landed position, and means sealing between the telescoping parts in surrounding relation to the aligned ends of the conduits.

15. Apparatus as defined in claim 14, wherein the surface includes a slot at one side of the shoulder into which the pin is moveable as it is engaged with the shoulder.

16. For use in performing operations within a subsea well by means of a pipe sring which is lowered through a conductor depending from a drilling vessel at the water surface and releasably connected at its lower end to a blowout preventer stack, said string having means for landing upon the head of the well on which the stack is mounted for depending therefrom into the well bore, apparatus for selectively closing the string so as to maintain control over the well upon raising the upper end of the string thereabove, said closing apparatus including a lower body having a bore therethrough which is connectible at its lower end to the lower end of the string, closure means within the body movable between positions opening and closing the bore therethrough, and fluid pressure responsive means for moving the closure means between opened and closed positions, an upper body having a bore therethrough which is connectible at its upper end to the upper end of the string, means on the bodies for releasably connecting the lower end of the upper body to the upper end of the lower body with their bores aligned, whereby the bodies may be lowered with the string into a position in which the lower body is disposed within the bore of the stack, said connecting means including a first cylindrical part on the upper body lowerable into longitudinally telescoping relation within a second cylindrical part on the lower body, means for landing the upper body on the lower body and sealing between them and for releasably latching such parts to one another, when so telescoped, the upper body having a series of conduits for receiving control fluid from a source at the wellhead, the lower body having a corresponding number of conduits for transmitting such control fluid to different the areas within the body including said fluid responsive means for moving the closure means, the upper and lower body conduits opening substantially radially to the telescoping parts thereof on generally the same horizontal level, means on the telescoping parts of said bodies for rotationally orienting the upper body about the vertical axes of the first and second parts into a position in which the ends of its conduits are generally aligned with the ends of the lower body conduits upon lowering of the telescoping first part thereon into landed position with respect to the telescoping second part on the lower body, said orienting means including a pin on one telescoping part and a surface about the circumference of the other part which are vertically movable into engagement with one another, as the upper body is so lowered, said surface having a shoulder thereon and extending circumferentially between upper and lower portions of the shoulder at a relatively small angle with respect to the horizontal, whereby said shoulder and pin are engageable upon rotation of the upper body about said vertical axes following engagement of the surface and pin, so as to locate said upper body in said position, and means sealing between the telescoping parts in surrounding relation to the aligned ends of the conduits.

17. Apparatus for releasably connecting the lower end of a pipe string to a well conduit disposed within a well bore, comprising a body having a part adapted to be lowered with the pipe string into telescoping and relation with respect to a part on the well conduit which has a locking recess thereabout, said body part including a first section connectible to the pipe string for rotation therewith, and a second section which is adapted to be held against rotation with respect to the well conduit, locking dogs having lugs carried by second body section for radial movement into and out of the recess when said body is so lowered, locking means carried by the body for longitudinal reciprocation between positions holding said lugs in locking position and releasing them from locking position, spring means urging the locking means into locking position, means forming an expandable and contractible pressure chamber between the body and a piston on the locking means, said body having conduit means for connecting said chamber with a source of control fluid at the surface which, when supplied to the chamber, overcomes the spring means to move the locking means to releasing position, means connecting the body sections against rotation while permitting longitudinal movement between them, a sleeve which is carried by the body part for movement between a first position holding the locking means in locking position and a second position in which the locking means permits the dogs to move to positions out of the recess, said sleeve being held against rotation but longitudinally moveable with respect to the second body section and threadedly connected to the first body section for movement between its first and second positions in response to rotation of the first body section with the pipe string in opposite rotational directions.

18. Apparatus as defined in claim 17, wherein the locking means has collet fingers which are opposite the lugs when the locking means is in locking position, and the sleeve moves into and out of positions holding the collet fingers in locking position.

19. For use in performing operations within a subsea well by means of a pipe string which is lowered through a conductor depending from a drilling vessel at the water surface and releasably connected at its lower end to a blowout preventer stack, said string having means for landing upon the head of the well on which the stack is mounted for depending therefrom into the well bore, apparatus for selectively closing the string including a body having a bore therethrough which is connectible as a part of the string, guideways in the body extending from the bore therethrough, rams slidable in the guideways between positions opening the bore of the body and closing the bore, cylinders in the body, pistons reciprocable in the cylinders and connected to the rams for moving them between opened and closed positions, and means responsive to the supply and exhaust of control fluid from a source at the surface level for causing the pistons to move the rams between opened and closed positions.

20. Apparatus of the character as defined in claim 19, wherein there are at least two sets of vertically spaced guideways, with the rams in one set of guideways being constructed to close upon an open bore, and the rams in the other set of guideways being constructed to shear a line in the bore.

21. Apparatus of the character as defined in claim 19, wherein there are at least two sets of vertically spaced guideways, with the rams in one set of guideways being constructed to close an open bore, and the rams in the other set of guideways being constructed to close about a line in the bore.

22. Apparatus of the character as defined in claim 21, wherein there is a third set of guideways vertically spaced from the other sets, with the rams in said third set being constructed to shear a line in the bore.

23. Apparatus of the character as defined in any one of claims 19 to 22, including continuations of the guideways and cylinders which extend through the outer side of the body and through which the rams and pistons may be moved into and out of the guideways and cylinders.

24. Apparatus of the character defined in claim 23, wherein the cylinders in the body extend parallel to and on opposite sides of the guideways.

25. Apparatus of the character as defined in any one of claim 24, wherein the means for causing the pistons to move includes means within the body for containing a source of fluid under pressure which connects with the cylinders on one side of the pistons to urge the rams toward closed position, and means in the body connecting with the cylinders on the other side of the pistons for supplying or exhausting the control fluid with respect thereto at a pressure which holds the rams open as long as such pressure is maintained.

26. Apparatus of the character defined in claim 25, including continuations of the guideways and cylinders which extend through the outer side of the body, walls removeably mounted across the guideways on the outer ends of the rams and across the cylinders on the outer sides of the pistons, the fluid contained within the body being on the outer ends of the pistons, and the control fluid being on the inner ends of the pistons, rods on the pistons extending through the walls of the cylinders, rods on the rams extending through the walls of the guideways, and yokes connecting the outer ends of the rods to one another and shiftable within recesses in the body on the outer ends of the continuation, said walls, upon removal, enabling the rams and pistons to be moved into and out of the guideways and cylinders through the continuations thereof.

27. Apparatus as defined in claim 26, including chamber means in the body spaced vertically of the rams and pistons and having a pressure divider therein, a charge of pressure fluid being contained on one side of the divider and the fluid being contained on one side of the divider and the fluid source being contained on the other side of the divider, and conduits in the body connecting the other side of the divider with the cylinders on the one side of the pistons.

* * * * *